United States Patent [19]

Focke

[11] Patent Number: 5,046,607

[45] Date of Patent: Sep. 10, 1991

[54] PACK CONTAINER, ESPECIALLY TRAY, FOR RECEIVING (CARDBOARD) PACKS

[75] Inventor: Heinz Focke, Verden, Fed. Rep. of Germany

[73] Assignee: Focke & Co. (GmbH), Verden, Fed. Rep. of Germany

[21] Appl. No.: 516,650

[22] Filed: Apr. 30, 1990

[30] Foreign Application Priority Data

May 11, 1989 [DE] Fed. Rep. of Germany ..... 3915408

[51] Int. Cl.[5] ..... B65D 71/70

[52] U.S. Cl. ..... 206/44.12; 206/557; 229/101; 220/8

[58] Field of Search ..... 206/457, 459, 44.12, 206/45.11, 557, 559, 565; 229/101; 220/8

[56] References Cited

U.S. PATENT DOCUMENTS

| | | | |
|---|---|---|---|
| 655,939 | 8/1900 | Overton | 229/101 X |
| 876,235 | 1/1908 | Quackenboss | 206/557 X |
| 1,120,955 | 12/1914 | Martin | 229/101 X |
| 2,369,728 | 2/1945 | Farkas | 206/557 X |
| 3,109,361 | 11/1963 | Nicoli | 229/101 X |
| 3,134,499 | 5/1964 | Johnson | 220/8 |
| 3,140,777 | 7/1964 | Gordan | 220/8 X |
| 3,924,734 | 12/1975 | Gardner et al. | 229/101 X |
| 3,929,274 | 12/1975 | Akkerman | 229/101 X |
| 4,274,577 | 6/1981 | Walsh, Jr. | 229/101 X |
| 4,564,118 | 1/1986 | Heyer et al. | 220/8 |

FOREIGN PATENT DOCUMENTS

| | | |
|---|---|---|
| 344076 | 7/1978 | Austria . |
| 2605599 | 4/1988 | France . |
| 223754 | 10/1924 | United Kingdom . |
| 614079 | 12/1948 | United Kingdom . |
| 1542842 | 3/1979 | United Kingdom . |
| 2020632 | 11/1979 | United Kingdom . |
| 2206563 | 1/1989 | United Kingdom . |

*Primary Examiner*—Paul T. Sewell
*Assistant Examiner*—Jacob K. Ackun, Jr.
*Attorney, Agent, or Firm*—Sughrue, Mion, Zinn Macpeak & Seas

[57] ABSTRACT

Pack container, especially tray, made of foldable material for receiving articles.

Trays are flat upwardly open containers which consist essentially of a bottom wall (12) and of low side walls (longitudinal rims 13, 14; transverse rims 15, 16) extending all round. They serve for receiving generally cuboid articles, especially (small) packs (11). Such trays (10) are increasingly also used for the display of sales articles directly for the ultimate consumer (shop trays).

To make it possible to load a tray (10) with packs (11) simply and without constraint, in such a way that the bottom wall (12) of the tray is covered with packs (11) completely, the tray can be enlarged in terms of the useful base surface and, after loading, be reduced to the "normal size". For this purpose, the bottom wall (12) is subdivided into two part bottoms (21, 22) moveable telescopically relative to one another.

There can be arranged approximately in the middle of the bottom wall (12) a filling piece (30) which is surrounded by the packs (11) and which forms a one-piece blank with the remaining parts of the tray and connects the part bottoms (21, 22) to one another.

9 Claims, 6 Drawing Sheets

PACK CONTAINER, ESPECIALLY TRAY, FOR RECEIVING (CARDBOARD) PACKS

BACKGROUND OF THE INVENTION

The invention relates to a pack container, especially tray, made of foldable material, such as corrugated cardboard, for receiving a multiplicity of articles, preferably (cardboard) packs, which stand on a bottom wall.

Flat upwardly open pack containers, so-called trays, often serve as transport containers for a multiplicity of smaller (cardboard) packs and at the same time as a sales container which is set up directly at the retail outlet together with the articles or packs to be sold. A tray of this type consists of a bottom wall as a standing surface for the articles or packs and of side walls of low height extending preferably all round, namely a rim. The dimensions of the tray and of the articles are so coordinated with one another that, when the tray is full, the articles cover its bottom wall without a gap.

The arrangement of the (cuboid) articles or packs without a gap on the bottom wall of the tray presents certain difficulties in the loading of the trays and sometimes also in the extraction of the articles. This applies, above all, to (carton) packs which cannot be grasped and transported in the region of an upwardly directed wall (upper wall), that is to say, for example, packs open completely or partially on the top side. In these cases, it is necessary to use a (mechanical) carrying or conveying member which grasps the pack (also) on the underside for putting it down on the tray.

SUMMARY OF THE INVENTION

The object on which the invention is based is to design a pack container or tray of the type mentioned in the introduction, in such a way that it becomes possible to use the base surface completely and without a gap for the articles to be received, but on the other hand loading and unloading can take place without constraint.

To achieve this object, the pack container according to the invention is characterized in that, for the purpose of loading with articles or for unloading, at least the bottom wall has a larger useful base surface than the standing surface taken up by the articles as a whole, and in that the bottom wall occupied by articles can be reduced in relation to the base surface, in such a way that the articles cover the standing surface of the bottom wall completely or assume a formation intended for transport and/or storage.

For loading and, where appropriate, unloading, the tray is brought into a shape with a maximum enlarged base surface, so that the number of articles assigned to the tray can be put down on the bottom wall of the tray easily, in particular without damaging one another. After the tray has been loaded, the latter or its bottom wall is reduced to the size corresponding to the standing surface of the articles. The bottom wall of the tray is now filled without a gap by the articles.

According to the invention, the bottom wall is formed from at least two parts (part bottoms) which can be pushed together telescopically, with a partial overlap, in order to reduce the base surface. To load the tray, the part bottoms are pulled apart, thereby enlarging the useful base surface, and, after loading, are pushed together to the actual tray size intended for transport and storage.

According to the invention, at least two side walls (rims) of the tray are also designed so that they can be pushed together or pulled apart, in correspondence with the bottom wall. The tray as a whole can thereby be enlarged and, after loading, reduced to "normal size".

According to a further proposal, the tray according to the invention consists of a single one-piece blank, the bottom wall and the side walls being formed by means of folds of blank regions marked by punchings and/or stampings.

According to a further proposal of the invention, the bottom wall is equipped with a fold-up filling piece which is preferably arranged approximately centrally and which is likewise part of the one-piece blank. The blank parts forming the filling piece serve at the same time for connecting the part bottoms. When these are being pushed together, the filling piece is at the same time erected into its final shape.

Further features of the invention are concerned with the design of the blank, such that at least the pushed-together "normal position" of the tray is locked by means of a catch connection. Furthermore, the tray is equipped with downwardly directed centering corner projections.

An exemplary embodiment of the invention is explained in greater detail below by means of the drawings. In these:

DETAILED DESCRIPTION OF A PREFERRED EMBODIMENT

Figure 1:
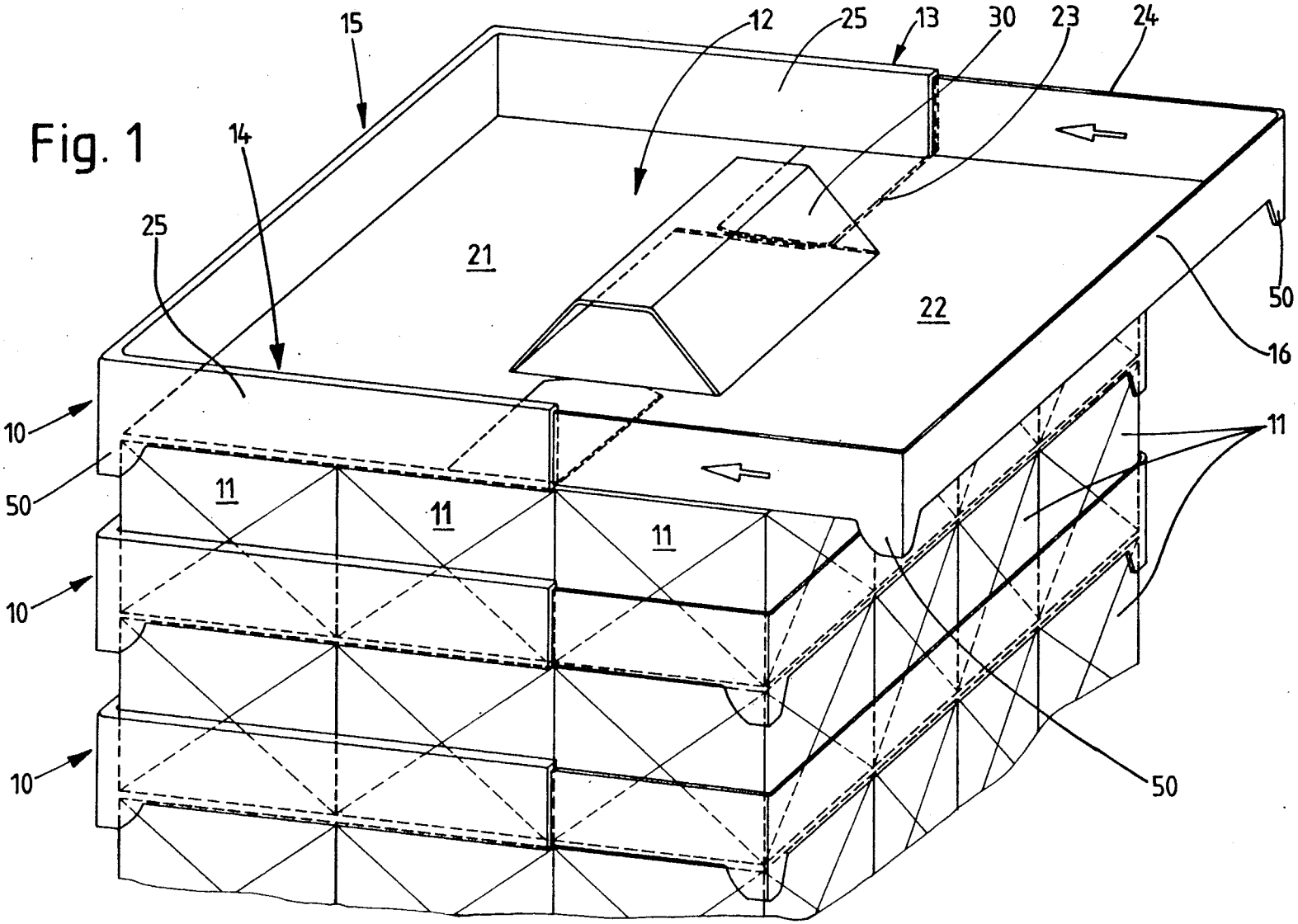
FIG. 1 shows a perspective representation of a group of partially filled containers (trays) stacked one above the other.

The drawings show details of an upwardly open flat container, namely a tray 10. The trays serve for receiving a multiplicity of cuboid articles, particularly smaller packs 11. These consist of cardboard and preferably serve for receiving confectionery items, for example chocolate bars. The packs 11 can be open completely or partially on the top side.

A layer of specially formed packs 11 of rectangular plan contour is arranged on a respective tray 10. The trays 10 serve for the temporary storage of the packs 11, but furthermore also as display means for the sale of the packs 11 or of the contents (so-called shop trays).

A tray 10 of the type shown here consists of a bottom wall 12 as a standing surface for the packs 11 and of side walls of low height extending all round, in the present exemplary embodiment this height being clearly lower than the height of the packs 11. The bottom wall 12 is surrounded or limited by two longitudinal rims 13 and 14 and two transverse rims 15 and 16. The abovementioned rims 13 . . . 16 enclose the contents of the tray 10.

Figure 2:
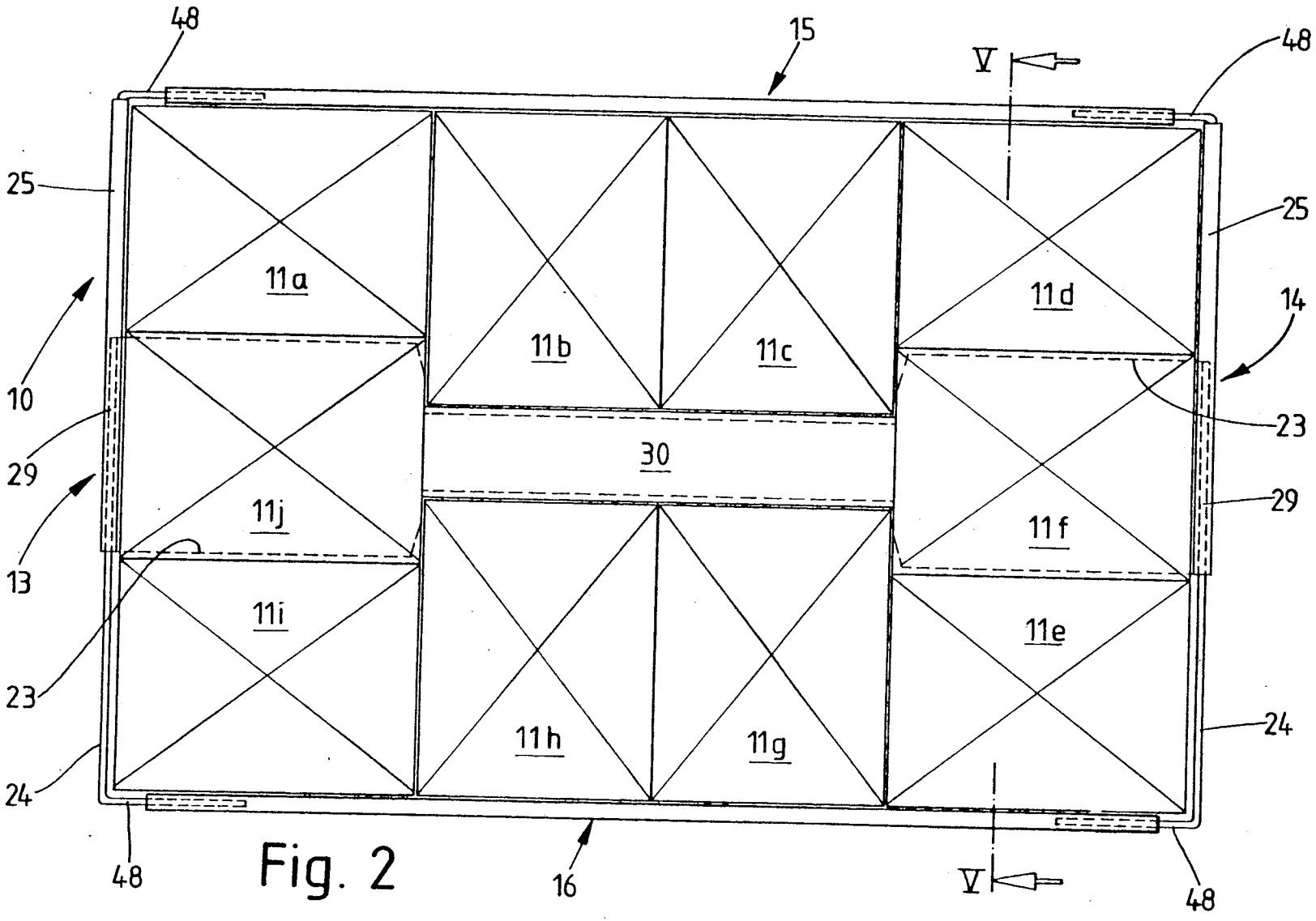
FIG. 2 shows a plan view of a filled container ready for use.

The tray or the free standing surface of the bottom wall 12 on the one hand and the dimensions of the packs 11 are so coordinated with one another that, when the tray is loaded and ready for transport, the standing surface of the bottom wall 12 is covered completely (FIG. 2). The dimensions ensure a special formation (relative position) of the packs. These are arranged closely confined.

Figure 3:
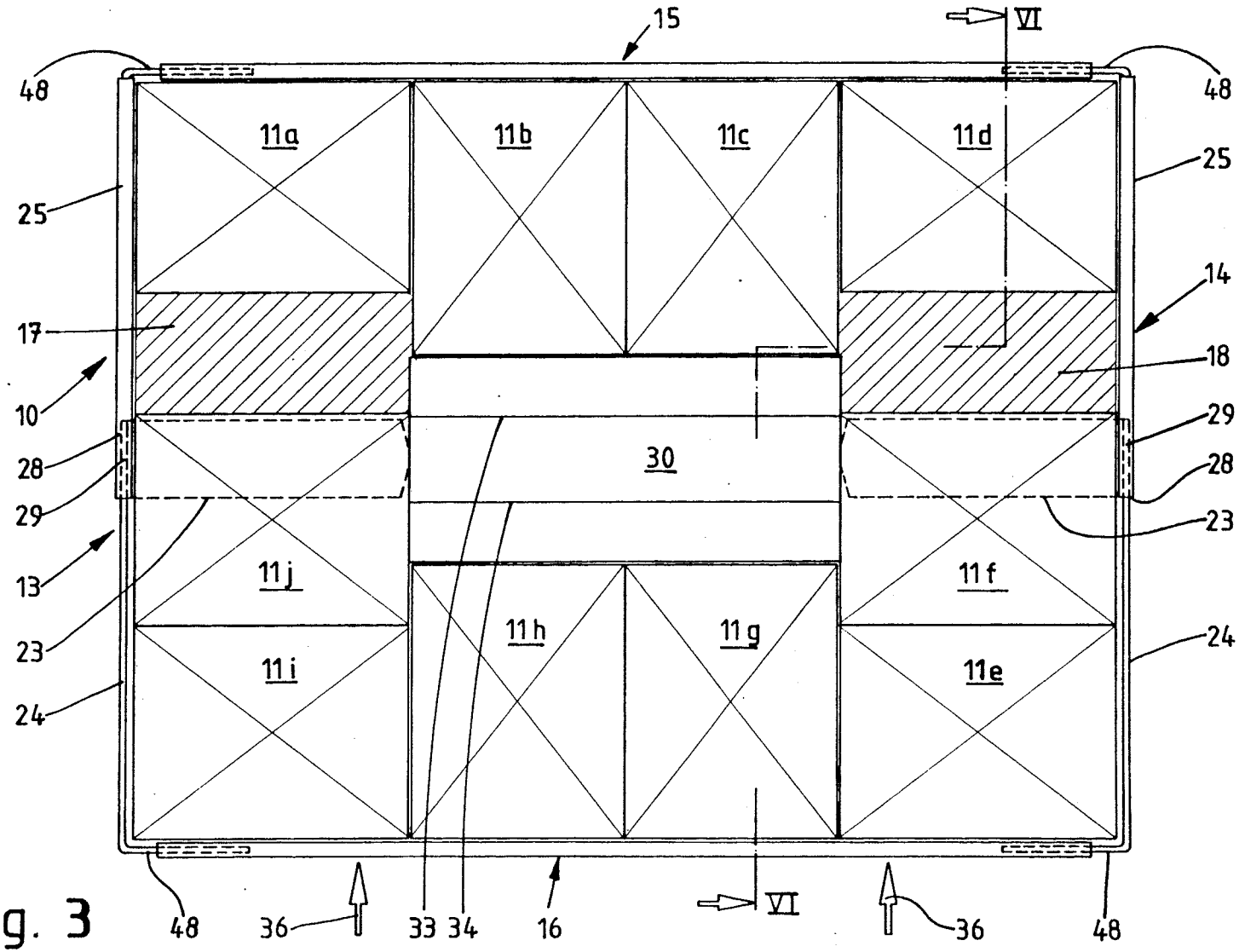
FIG. 3 shows a representation corresponding to that of FIG. 2, with a container in an enlarged form.
Figure 4:
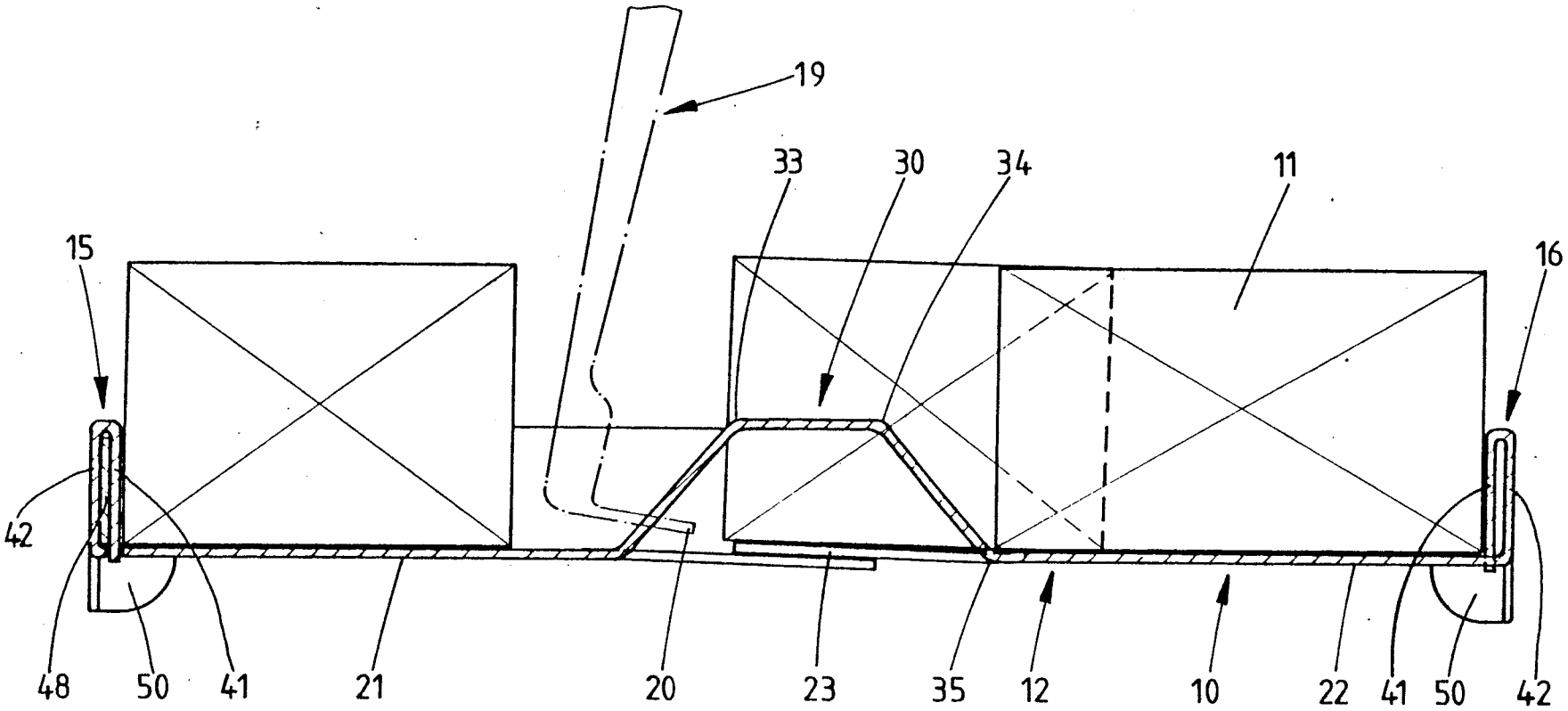
FIG. 4 shows a cross-section in the plane IV—IV of FIG. 3.

For loading the trays 10 with the packs 11 and, if appropriate, for extracting these, the tray 10 or its bottom wall 12 can be enlarged in terms of the useful base surface. FIG. 3 shows the enlarged form of the tray 10. As is evident, (rectangular) free surfaces 17 and 18 remain on the bottom wall 12 after the tray 10 has been loaded with packs 11 completely. These free surfaces 17 and 18 allow lateral access to the packs 11 during the loading operation or allow the use of transport and handling members which take effect (also) on the underside of the packs 11. FIG. 4 shows diagrammatically part of a lifting fork 19 with a carrier leg 20 resting against the underside of the pack 11. A latitude of movement is necessary next to the particular pack 11 for the use of a handling appliance of this type.

The bottom wall 12 can be pushed together and pulled apart in order to vary the effective base surface. In the exemplary embodiment illustrated, the bottom wall consists, in the region of the useful base surface or standing surface, of two parts, namely of two part bottoms 21 and 22. The division extends approximately in the middle region of the tray 10 between the transverse rims 15, 16. The dimensions of the part bottoms 21, 22 are such that they overlap one another in any relative position. An overlap strip 23 has a smaller width when the tray 10 is enlarged (FIG. 3) than when the bottom wall 12 of the marketable tray is pushed together (FIG. 2). Correspondingly to the divided design of the bottom wall 12 the longitudinal rims 13, 14 are also of variable length according to the particular size of the bottom wall 12. For this purpose, the longitudinal rims 13, 14 are divided, particularly in the region of the overlap strip 23 of the bottom wall 12. The part rims 24 and 25 obtained are telescopically displaceable relative to one another in order to vary the effective length. In the exemplary embodiment shown, the part rim 24 is made single-ply or single-walled, whilst the part rim 25 is made double-walled, particularly with two rim walls 26, 27 arranged at a distance from one another. Between these is formed a slot-shaped cavity 28, into which the part rim 24 penetrates, specifically with a tongue-shape guide piece 29. The depth of penetration of the latter varies when the tray 10 is enlarged or reduced.

A further special feature of the present tray is that, for the exactly fitting positive arrangement of the packs 11 on the bottom wall 12 of the tray 10, a filling piece 30 on the bottom wall 12 takes effect and fills a region within the tray 10 not occupied by packs 11. In the present exemplary embodiment, the filling piece 30 is arranged in the middle of the bottom wall 12.

Figure 5:
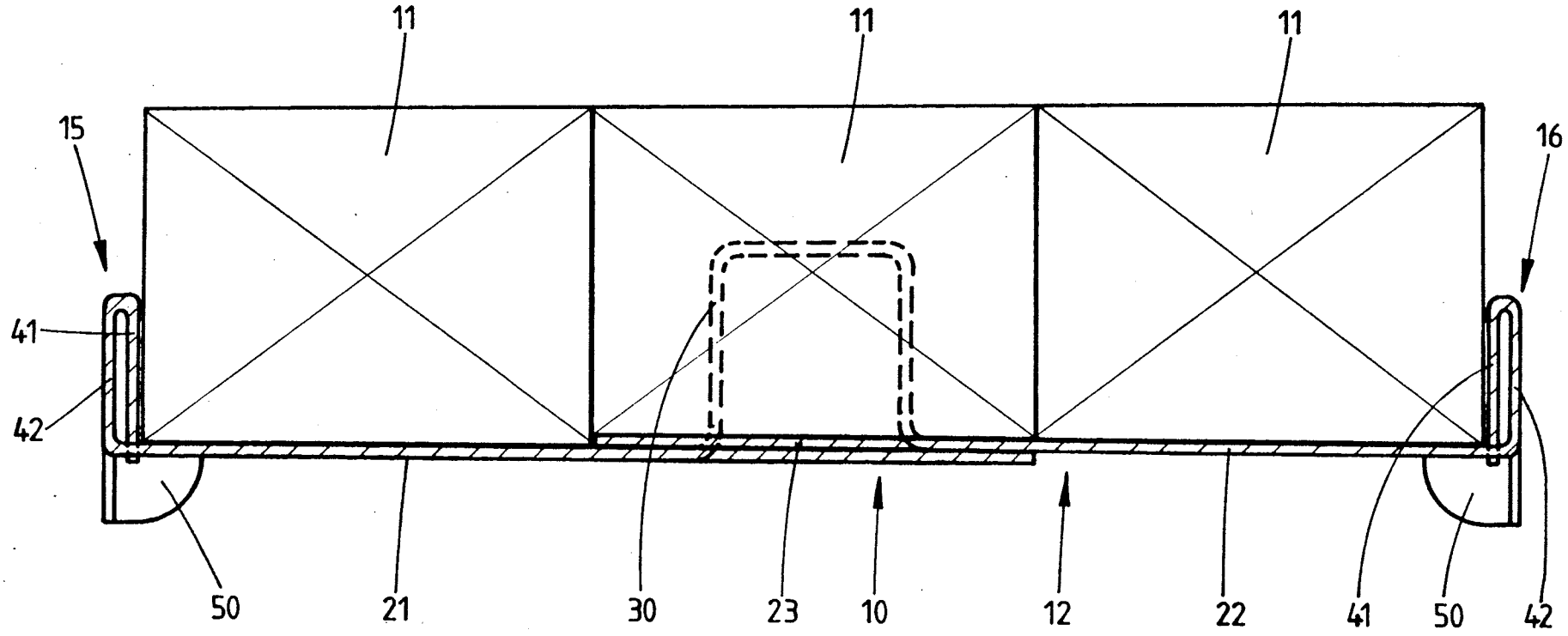
FIG. 5 shows a cross-section in the plane V—V of FIG. 2.

The filling piece 30 is formed by parts of the tray 10 or of the bottom wall 12. The part bottoms 21, 22 are connected to one another in the region of the filling piece 30 by means of the latter, particularly by means of a folding piece 31 forming the filling piece 30. This is of rectangular design in the present case. By means of four parallel folding edges 32, 33, 34 and 35, when the bottom wall 12 is pushed together the folding piece 31 can be folded up from an originally flat initial shape of trapezoidal cross-section (FIG. 4) into a rectangular or cuboid end position (FIG. 5). There is no overlap of the part bottoms 21, 22 in the region of the filling piece 30, the overlap strip 23 therefore extending only outside the filling piece 30. This, as seen in cross-section, is designed as a hollow body open downwards and to the sides or end faces. The length and width of the filling piece 30 are such that a central cavity remaining between the packs 11, otherwise arranged so as to cover the surface, is filled.

The above-described design of the tray 10, particularly the variable dimension of the bottom wall 12, makes it possible to carry out a mechanizable loading operation by means of a lifting fork 19 or a similar appliance. At the same time, with the predetermined dimensions of the tray 10 and of the packs 11, a special loading operation is advantageously employed. The packs 11 are put down in a specific sequence on the bottom wall 12 in its enlarged, pulled-out shape (FIG. 3), specifically always with the proviso that one of the larger longer sides of the pack 11 put down is free for the engagement of the handling appliance (lifting fork 19).

Under this precondition, the pack 11*a* is first put down on the bottom wall in one corner of the tray 10. The pack 11*b*, directed transversely, is put down against the narrow side of this, and the pack 11*c* is put down next to it in the same relative position. The pack 11*d* is then arranged laterally next to this in a relative position corresponding to that of the pack 11*a*. The continuation of the loading operation then takes place on the opposite side of the bottom wall by putting down the pack 11*e* in the same relative position in the corner located diagonally opposite the pack 11*a*. The pack 11*f*, arranged in the same direction, is thereafter put down next to it. The pack 11*g* is arranged transversely relative to these two and next to them, followed next to it by the pack 11*h* in a position arranged in the same direction. The pack 11*i* is then put down in the corner still free, specifically in a relative arrangement corresponding to that of the packs 11*a*, 11*d* and 11*e*. The pack 11*j* finally follows next to it.

As is evident, the packs 11*b* and 11*c* on the one hand and 11*g* and 11*h* on the other hand are located on both sides of the elongate filling piece 30. The free surfaces 17 and 18 remain respectively between the packs 11*a* and 11*d* on the one hand and the packs 11*f* and 11*j* on the other hand, so that the pack 11*f* and, above all the pack 11*j* placed last on the bottom wall 12 is free in the region of one (longitudinal) side for the use of a loading appliance (lifting fork 19).

After the formation according to FIG. 3 has been produced, the tray 10 as a whole is pushed together in the direction of the longitudinal rims 13, 14, particularly according to the arrows 36, thereby eliminating the free surfaces 17, 18 and with the filling piece 30 being folded up into the position according to FIG. 2.

Figure 6:
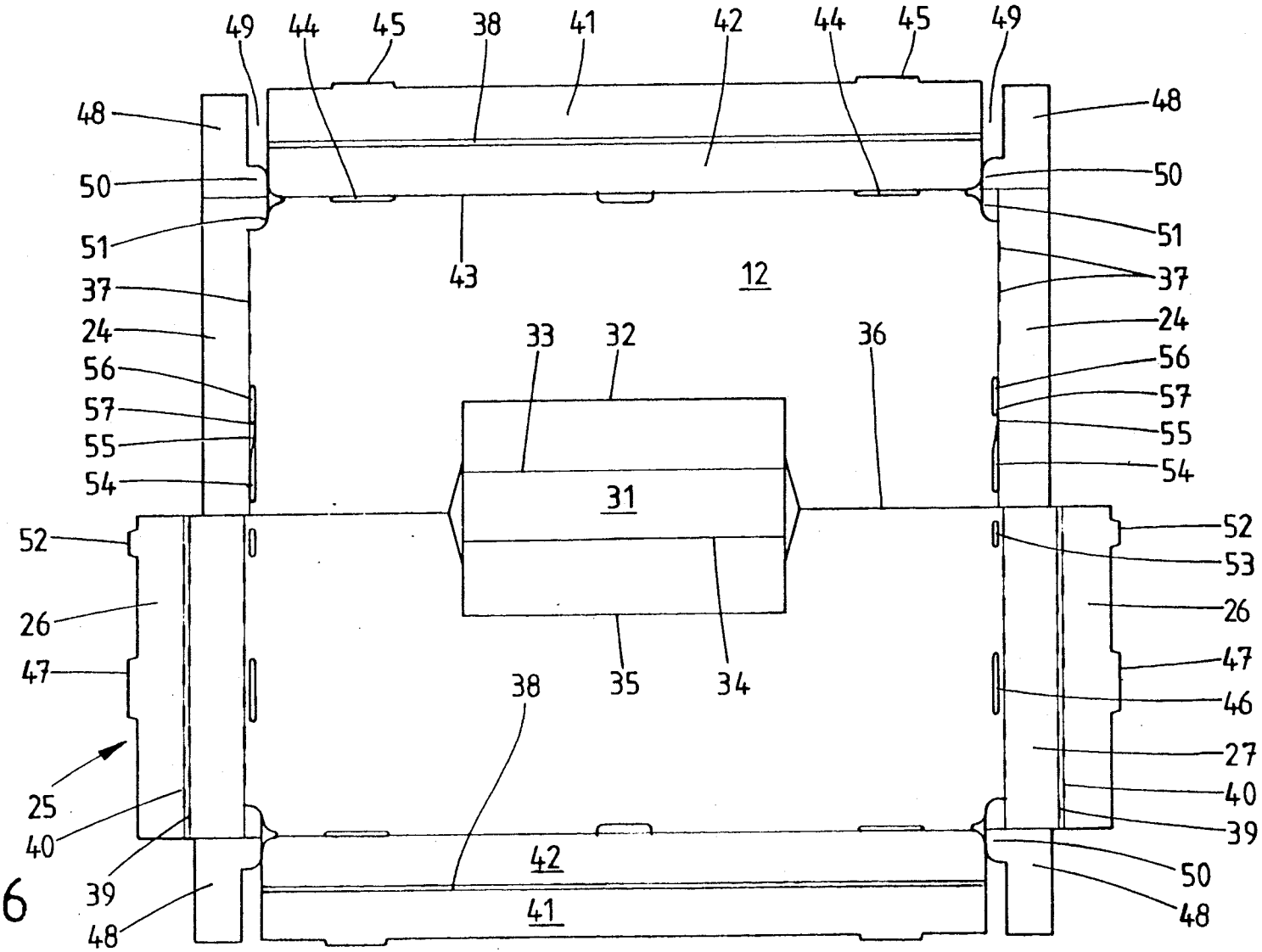
FIG. 6 shows a spread-out one-piece blank for producing a container.

The tray 10, with all its parts, is formed from a single continuous blank which is shown in spread-out form in FIG. 6. The blank consists of cardboard, especially corrugated cardboard. A blank part forming the bottom wall 12 is subdivided approximately centrally into the part bottoms 21, 22 by means of a transversely directed severing cut 36. The severing cut 36 is interrupted in the middle region so as to form a blank part for the filling piece 30. The blank is held together as a one-piece structure by means of the latter.

At the sides, the severing cut 36 extends as far as the free edge of the blank. Blank parts for forming the longitudinal rims 13, 14 are thereby separated from one another. This results, on the one hand, in the part rim 24 consisting merely of one blank strip and, on the other hand, in the part rim 25 consisting of two blank strips for forming the rim walls 26 and 27.

Punched in the region of folding lines of the above-mentioned blank parts are slots 37 which make it easier to fold the blank consisting of relatively stiff material. To form an upper edge 38, consisting of two folds, of the part rim 25, two rows of slots 39 and 40 are made at a short distance from one another in order to delimit the rim walls 26 and 27.

The transverse rims 15, 16 are likewise of double-walled design with an inner wall 41 and outer wall 42. Slot-shaped recesses 44 are made in the blank in the region of a folding edge 43 between the outer wall 42 and bottom wall 12. With the transverse rims 15, 16 folded, projections 45 arranged on the edge of the inner wall 41 penetrate positively into these recesses 44 in order to stabilize the fold. Corresponding recesses 46 and projections 47 are assigned to the double-walled part rim 25.

The corners of the tray 10 are likewise of special design. Attached to the longitudinal rims 13, 14 20 are free-standing corner tabs 48 which, on the ready-folded tray 10, penetrate into a slot-shaped cavity formed between the inner wall 41 and outer wall 42 of the transverse rims 15, 16 and thus ensure a firm corner connection of the rim extending all round.

The transverse rims 15, 16 are made shorter in the region of the corners than the corresponding dimension of the tray 10 as a result of a punched-out portion 49. This dimensional difference is bridged by the corner tabs 48 (FIG. 2 and FIG. 3). The punched-out portion 49 provides a downwardly directed diagonally folded centering tab 50 which, on the folded tray, forms a downwardly directed angular projection. This guarantees a non-slip centred mounting of the trays 10 one above the other, the diagonally folded centering tabs 50 being supported respectively on the packs 11 of a tray located underneath (FIG. 1). The centering tab 50 is separated from the adjoining blank parts by means of a U-shaped punching cut 51 and can thus be folded freely into the angular position.

The tray 10 is secured in the pushed-together position (FIG. 2) against unintentionally being pulled apart, specifically by means of a snap or catch connection. This is made possible by a relatively short projection 52 on the free edge of the inner rim wall 26. In the folding position, this passes, on the one hand, through an associated matching recess 53 in the bottom wall 12 or in the part bottom 22. The dimension of the projection 52 is selected so that this projects downwardly beyond the bottom wall 12. The projection 52 is assigned recesses in the part bottom 21, particularly in the line of movement of the projection 52 when the part bottoms 21, 22 are being pushed together. In the initial position, that is to say with the tray 10 folded, but pulled apart, the projecting part of the projection 52 protrudes into a sliding slot 54. The pulled-apart end position of the part bottoms 21, 22 is determined by its end facing the severing cut 36. The opposite end of the sliding slot 54 merges into a catch slot 56 via a narrowing or a following severing cut 55. When the tray 10 is pushed together to its final size, the projecting part of the projection 52 moves out of the sliding slot 54 through the severing cut 55 and into the catch slot 56. The end limitation 57 of the latter forms a bearing for the projecting part of the projection 52 against a return movement to the initial position and therefore against a pulling apart of the pushed-together part bottoms 21, 22.

The tray 10 thus acquires a stable shape in the filled end position (FIG. 2 and FIG. 5).

What is claimed is:

1. Pack container, in the form of a tray made from a single-piece blank of foldable material, for receiving a plurality of packs (11), said tray comprising:

a bottom wall (12) on which the packs (11) stand and which has lateral edges provided with mutually opposite upstanding longitudinal rims (13, 14) and upstanding transverse rims (15, 16); said bottom wall (12) being divided and comprising two part bottoms (21, 22) for varying a base surface of said bottom wall (12) in accordance with an amount of partial overlap (23) of said two part bottoms; and a folding piece (31) connecting said two part bottoms (21, 22) to one another to form the single-piece blank; said folding piece (31) being upwardly foldable, upon pushing together of said two part bottoms (21, 22), to form an upstanding filling piece (30) between packs (11) standing on said bottom wall (12), said longitudinal rims (13, 14) being divided in a corresponding way to said bottom wall (12) and comprising two part rims (24, 25), one part rim (24) being single-walled and the other part rim (25) being double-walled, such that said one part rim (24) can penetrate displaceably by means of a guide piece (29) into a cavity (28) between rim walls (26, 27) of said other part rim (25).

2. Pack container according to claim 1, wherein said part bottoms (21, 22) are connected to one another in a central region of said bottom wall (12) by means of said folding piece (31).

3. Pack container according to claim 1, wherein said other part rim (25) has, at free edges thereof, projections (45, 47) which positively penetrate into slot-shaped recesses (44, 46) in said bottom wall (12).

4. Pack container according to claim 3, wherein said longitudinal rims (13, 14) have at ends thereof angled corner tabs (48) which connect said longitudinal rims (13, 14) to said transverse rims (15, 16) and which penetrate into a region between an inner wall (41) and an outer wall (42) of said transverse rims (15, 16).

5. Pack container according to claim 1, further comprising catch connection means for, in the pushed-together position, securing said divided bottom wall and said divided longitudinal rims against movement apart.

6. Pack container according to claim 5, wherein said other part rim (25) is integral with one part bottom (22) and has a projection (52) which, with the bottom wall (12) in the pushed-together position, engages in an anchoring manner a catch slot (56) of the other part bottom (21).

7. Pack container according to claim 2, wherein said filling piece (30) is upwardly foldable from an initial position of trapezoidal cross-section, with the bottom wall (12) widened, into an end position of rectangular cross-section with said bottom wall is pushed together.

8. Pack container according to claim 4, further comprising centering tabs (50) which are located at four corners of said bottom wall (12) and which enclose a layer of packs (11) of an underlying tray.

9. Pack container according to claim 6, wherein said projection (52) engages in a sliding manner an elongated recess (54) in said other part bottom (21), when said part bottoms (21, 22) are pulled apart.

* * * * *